United States Patent [19]

Fuller et al.

[11] Patent Number: 4,978,066

[45] Date of Patent: Dec. 18, 1990

[54] FAST ACTING AIRPOWERED WATER DISPLAYS

[75] Inventors: Mark W. Fuller, Studio City; Alan S. Robinson, El Monte, both of Calif.

[73] Assignee: Wet Designs, Universal City, Calif.

[21] Appl. No.: 393,560

[22] Filed: Aug. 14, 1989

[51] Int. Cl.[5] ..... B05B 17/08

[52] U.S. Cl. ..... 239/12; 239/23

[58] Field of Search ..... 239/12, 16, 17, 20, 239/22, 23, 72, 124, 126, 211, 571, 575; 137/78.5

[56] References Cited

U.S. PATENT DOCUMENTS

| | | | |
|---|---|---|---|
| 151,003 | 5/1874 | Briesen . | |
| 914,419 | 3/1909 | Ionides . | |
| 3,667,673 | 6/1972 | Knudsen | 239/1 |
| 3,722,819 | 3/1973 | Hall et al. . | |
| 4,128,205 | 12/1978 | Coash | 239/1 |
| 4,591,094 | 5/1986 | Morris | 239/204 |
| 4,594,697 | 6/1986 | Pascouet . | |
| 4,852,801 | 8/1989 | Fuller et al. | 239/12 |
| 4,892,250 | 1/1990 | Fuller et al. | 239/20 |

FOREIGN PATENT DOCUMENTS

| | | | |
|---|---|---|---|
| 1228804 | 5/1986 | U.S.S.R. . | |
| 19971 | of 1912 | United Kingdom | 239/22 |

*Primary Examiner*—Andres Kashnikow

*Assistant Examiner*—Karen B. Merritt

[57] ABSTRACT

Fast acting airpowered water displays which may be computer controlled to operate over a wide range of duration and timings and methods of operating the same are disclosed. The water displays are comprised of one or more nozzles directed upward, typically just above or just below the water level in a fountain pool. Each nozzle is connected to a water reservoir submerged, at least in part, in a fountain pool and coupled adjacent the bottom of the reservoir to the inlet for the nozzle. The water reservoir, which may be in the form of a pipe of a substantial diameter, is also coupled to a check valve submerged in the fountain pool to allow water to refill the reservoir but to prevent water from escaping therefrom through the check valve. A solenoid valve controllably connects the upper portion of the water reservoir to a supply of air under pressure. The solenoid valve is operative between a first condition coupling the supply of air under pressure to the upper portion of the water reservoir, and a second condition venting the upper portion of the reservoir to the atmosphere. This arrangement allows operation of the water display in various ways ranging from short repetitive bursts of water up to an explusion of all the water in the reservoir in a single burst. Various features and alternate embodiments, including computer control, are disclosed.

42 Claims, 2 Drawing Sheets

FAST ACTING AIRPOWERED WATER DISPLAYS

BACKGROUND OF THE INVENTION

1. Field of the Invention

The present invention relates to the field of water displays.

2. Prior Art

Various types of airpowered water displays are well-known in the prior art. By way of example, U.S. Pat. No. 151,003 discloses airpowered parlor fountains having a base in the form of a pressure vessel containing water and having an air pump adjacent the top thereof, an unpressurized intermediate section and an upper fountain display section for the decorative discharge of water from the lower pressure vessel for collection in the central section for ultimate recirculation upon venting and recharging of the system. U.S. Pat. No. 914,419, on the other hand, is addressed to an automatic fountain of the same general type, disclosing a control valve therefor. In fountains of this type, the water flow is normally controlled by a mechanical valve in the water line itself, being manually turned on and off as desired. As such, such fountains are usable only as steady flow devices, having as their attraction the decorative flow of water as opposed to decorative and/or attention getting changes in the flow thereof.

In U.S. Pat. No. 3,722,819, pulsed jet riot apparatus is disclosed wherein a compressed gas is passed to a chamber having liquid therein so that upon actuation of a quick opening valve, the liquid is forced from the chamber through an acceleration tube and out a nozzle. The quick opening valve may be positioned between the pressurized gas source and the liquid chamber, or it might be in the acceleration tube. When placed between the pressurized gas and the liquid chamber, one would expect a very rapid turn on capability for the apparatus. There is however, no way of "turning off" the apparatus, as turning off the quick acting valve will merely leave the chamber pressurized so as to continue to expel water therefrom with a diminishing velocity until the pressure falls to substantially atmospheric, or more likely, until sufficient water is expelled through the nozzle to vent the pressure chamber to atmosphere through the nozzle. In its intended operation, a separate water inlet valve is provided to allow the refilling of the chamber. The assignor of the present invention has a water display having similar characteristics for placement in a body of water, the structure being much simpler in design and self filling after each firing cycle from the body of water itself. In particular, those systems utilize a vertical pipe having a check valve adjacent the bottom thereof for the filling of the pipe, and a nozzle at the top thereof for the expulsion of the water therethrough. Pressurized air for driving the system is controllably delivered to the bottom of the column of water within the pipe without any separation between the air and water by way of a piston or any other structure. Relatively massive and impressive water displays may be generated using this technique. However, as with the '819 patent, once fired the water is expelled until the pressurized air becomes vented through the exit nozzle, thereby not being controllable in duration and resulting in the exhaust noise when so vented.

Finally, Russian Pat. No. 1,228,804 and U.S. Pat. No. 4,594,697 are of background interest, the former disclosing an impulse sprinkler utilizing a combustion chamber for pressurizing the same and the latter disclosing a pneumatically operated liquid slug projector.

BRIEF SUMMARY OF THE INVENTION

Fast acting airpowered water displays which may be computer controlled to operate over a wide range of duration and timings and methods of operating the same are disclosed. The water displays are comprised of one or more nozzles directed upward, typically just above or just below the water level in a fountain pool. Each nozzle is connected to a water reservoir submerged, at least in part, in a fountain pool and coupled adjacent the bottom of the reservoir to the inlet for the nozzle. The water reservoir, which may be in the form of a pipe of a substantial diameter, is also coupled to a check valve submerged in the fountain pool to allow water to refill the reservoir but to prevent water from escaping therefrom through the check valve. A solenoid valve controllably connects the upper portion of the water reservoir to a supply of air under pressure. The solenoid valve is operative between a first condition coupling the supply of air under pressure to the upper portion of the water reservoir, and a second condition venting the upper portion of the reservoir to the atmosphere. This arrangement allows operation of the water display in various ways ranging from short repetitive bursts of water up to an expulsion of all the water in the reservoir in a single burst. Various features and alternate embodiments, including computer control, are disclosed.

DETAILED DESCRIPTION OF THE INVENTION

Figure 1:
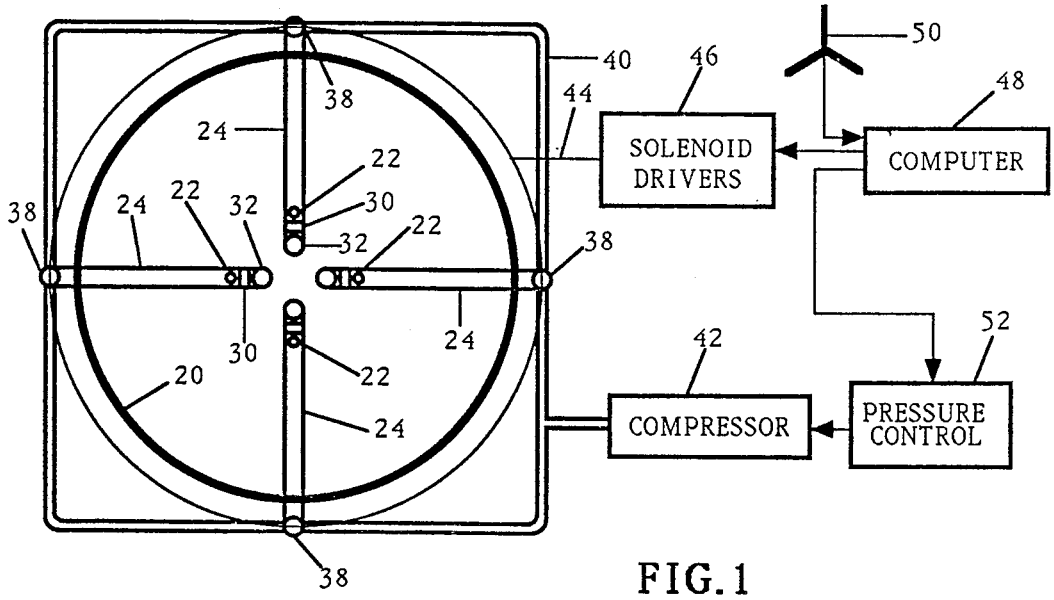
FIG. 1 is a schematic block diagram of an exemplary system in accordance with the present invention.
Figure 2:
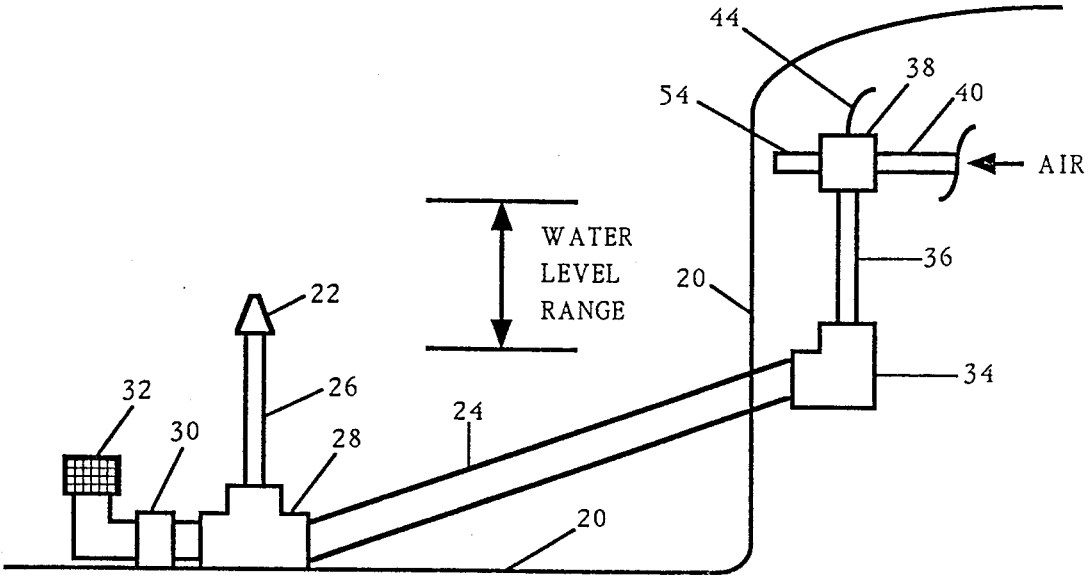
FIG. 2 is a side view of a portion of the apparatus of FIG. 1 illustrating a typical water display nozzle 22 and associated apparatus for the operation thereof.

First referring to FIGS. 1 and 2, a preferred embodiment of the present invention may be seen. As shown therein, a fountain pool defined by pool wall 20 contains four fountain nozzles 22 supported typically just above, substantially even with, or just below the water level in the pool. The nozzles 22 are coupled in this embodiment to a relatively large pipe 24 through a substantially vertically oriented pipe 26, which preferably is at least somewhat larger than the outlet of nozzles 22, and which may be as large as or larger than the pipe 24, if desired. Also coupled to each of pipes 24 through Tee couplings 28 are check valves 30 which substantially freely allow water flow through the check valves from the fountain pool into pipes 24 and 26 in response to a differential pressure thereon, but which prevent any substantial flow of water therefrom back into the fountain pool. The inlet from the fountain pool to each of the check valves 30 is preferably protected by a strainer 32 of substantial size which will prevent, particularly in outdoor pools, leaves and other debris from entering the check valves and interfering with the intended operation thereof, but which will relatively freely pass water into the submerged piping.

Pipes 24 are generally inclined upward from a low adjacent Tee couplings 28 to elbow couplings 34 which in turn are coupled through substantially vertical lines 36, each to an electrically operated solenoid valve 38. The solenoid valves 38 are manifolded together through line 40 to an air compressor 42 supplying air under pressure thereto. Such air compressors may include some form of compressed air reservoir (not independently shown) so that the supply of compressed air to solenoid valves 38 may substantially exceed the output capacity of compressor 42, at least for a short period of time.

Each of the solenoid valves 38 are electrically connected through a line 44 to a respective one of the solenoid drivers 46 controlled by computer 48. Also, the embodiment shown includes the further feature of a wind sensor 50 for providing an input to the computer 48 responsive to the local or ambient wind condition, and a pressure control 52 controlled by the computer for controlling the output pressure of the air compressor 42 to the solenoid valves 38, typically reducing the pressure, or at least the maximum pressure responsive to increasing wind velocity, and perhaps based on other parameters such as time or based on music or other program control. The pressure control 52 in the preferred embodiment actually controls the compressor speed to control the output thereof, though other forms of pressure control could also readily be used, such as by way of example, an electrically controllable valve at the compressor output controlling the output flow of the compressor based on the down stream air pressure so as to limit the down stream pressure to that desired at the time.

The system described so far operates as follows; each of the solenoid valves 38 are operative between one of two states, the first coupling line 40 to respective one of lines 36, and the second blocking line 40 and venting line 36 to the atmosphere through the exhaust port 54 thereon. In the quiescent state, namely the second state of a solenoid valve 38, check valve 30, a relatively large check valve in comparison to the respective nozzle 22, will open, allowing water to quickly fill all the system located below the water level in the pool. In general, the system normally will be filled with water up to the water line, with solenoid 38 being located thereabove and very quickly electrically operable to either couple high pressure air to the system, or alternatively vent the system to an atmosphere to quickly stop the flow of water through the respective nozzle and to allow the system to quickly refill thereafter.

As may be seen in FIG. 2, the submerged piping, primarily each of pipes 24, act as water reservoirs for the respective nozzle 22, being coupled adjacent the bottom of pipe 24 to the line supplying the respective nozzle with water. The solenoid valves 38 on the other hand are effectively coupled adjacent the top of the water reservoir pipes 24 to pressurize the water therein and force the same out through the nozzle without injecting air into a region which could be swept out of the nozzle with the water. Thus, in the preferred embodiment, it is desired to define a uniform unaeriated flow stream out of nozzles 22, or alternatively if aeriation is desired, to provide aeriation by entrainment of air into the water stream at the nozzles themselves rather than injecting air into the flow stream being supplied to the nozzles. It is of course further preferred in the preferred embodiment that the air under pressure be supplied adjacent the top of each water reservoir so that substantially all of the water therein may be forced outward through the nozzles 22 without any of the pressurizing air also being similarly expelled, and further for the reason that such injection of pressurized air makes the same directly accessible for immediate and rapid venting when the solenoid 38 is changed to the second state, venting line 36 to the atmosphere through port 54. It is for a similar reason that pipes 24 are inclined, namely so that the high pressure air does not have an easy path around the water in pipes 24 to the nozzles.

As stated before, line 24 is preferably much larger in diameter than nozzle 22, with line 26 preferably also being larger than nozzle 22. As an example, consider a system wherein the nozzles 22 have a ½ inch flow diameter and reservoir pipes 24 have a 3 inch inner diameter. Thus pipes 24 would have six times the diameter of the nozzles connected thereto, or thirty six times the area of the nozzles. Thus, when water is being expelled from a particular nozzle because of high pressure air being directed through solenoid valve 38 and line 36 to the water in the respective pipe 24, the velocity of the water in the pipe 24 will only be 1/36 of the velocity of the water in the nozzle. Thus, the dynamic pressure of the low velocity flow in the pipe 24 will only be 1/1296 of the dynamic pressure of the water flowing through the nozzle. Consequently, the kinetic energy of the water in pipes 24 will be very low, resulting in the near instant turn off of the flow through nozzle 22 when the respective solenoid valve 38 vents the high pressure air driving that nozzle to atmosphere.

There is of course also flow water in line 26 having a velocity and kinetic energy depending on the length and diameter of that line. From these considerations it would be preferable to have lines 26 be large, like lines 24. On the other hand, if the top of nozzle 22 is above the water level in the pool, the water level in lines 26 will drop between the time flow through the nozzle stops and the system refills. If the system is to be fired again before refilling has been completed, the resulting air in line 26 may cause a popping noise, a water hammer in the respective portion of the system and a resulting initial very high energy water spurt. For these reasons it is preferable to keep lines 26 relatively small so that the total amount of air in any one line 26 can never be very high.

If desired, one could also place a check valve in each of lines 26 to allow water to flow out of the respective nozzle 22, but to not reverse direction so as to be able to draw air into the system through the nozzles. Such a check valve preferably should be relatively fast acting, though a spring loaded or substantial gravity driven check valve could be used for this purpose as such valves would only need to open in response to substantial differential pressure there across, in comparison to check valves 30 which preferably will open in response to only a very few inches of water or less. Further, check valves 30 may be placed in lines 24 rather than on the other side of Tees 28, perhaps closer to the elbow 34, though still sufficiently below the water level in the pool so as to be positively opened by the water pressure at that depth of water in the pool. At such a location, check valves 30 would not be subjected to the dynamic pressure of the flowing water in pipes 24 at the time the same were vented to the atmosphere by solenoid valves 38, thus enabling the same to open to refill pipes 24 even before the flow through nozzles 22 completely stops.

Figure 3:
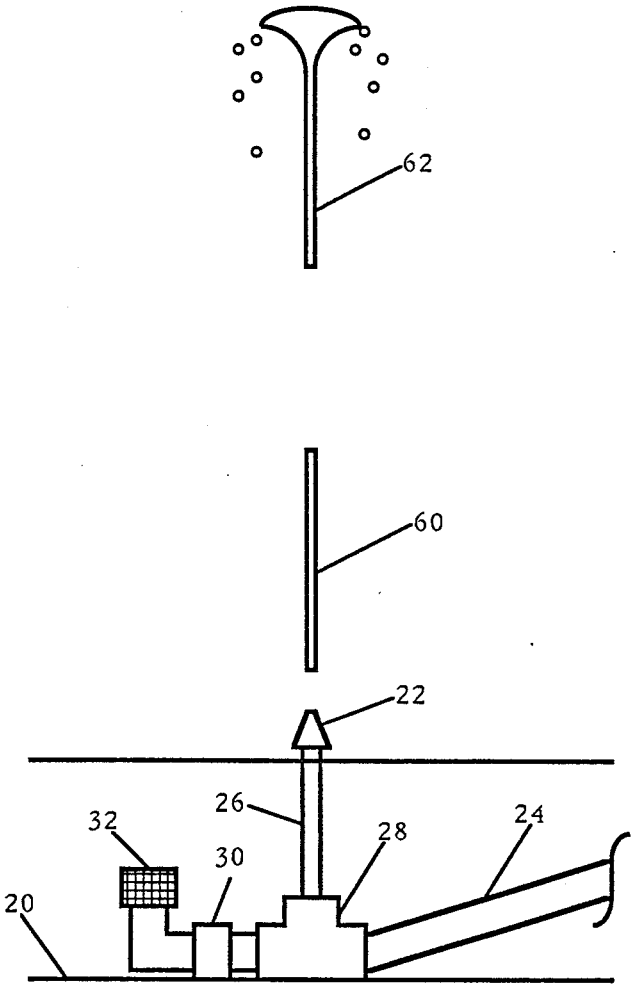
FIG. 3 is a side view of a typical nozzle 22 illustrating the type of water display which may be achieved with the present invention.

The advantages of the system just described may be seen in the schematic drawing of FIG. 3. In particular, because the air pressure driving the water expelled from each nozzle may be very quickly turned on and turned off and because there is not much kinetic energy in the water in the system, the solenoid valves may be operated to provide bursts of water ranging from a time period corresponding to the expulsion of substantially all of the water in the supply or reservoir for the respective nozzle, down to very short bursts as one might use in conjunction with music, etc., and/or to provide animation in the water display by the coordination of the operation of the multiple solenoid valves. This is schematically illustrated in FIG. 3, wherein a short burst of water 60 is shown travelling upward from nozzle 22, with a previously discharged burst 62 reaching the top of its trajectory and starting to fall back into the pool of water therebelow. Obviously, with a plurality of nozzles disposed such as in a linear or two-dimensional array, the bursts of water therefrom may be sequenced, varied in duration, coordinated with music, dance, etc., to provide a simple yet dynamic and attention getting display, all through program control of computer 48 (FIG. 1) which alternatively may itself also play and/or control other simultaneous events such as by way of example, the accompanying music.

Normally, to provide substantially noise free operation, the duty cycle of operation of each of the solenoids 38 should be limited so that at least some water supply will remain for each of the nozzles 22 to prevent the air under pressure driving the respective nozzle from itself being directly exhausted from the nozzle, though in general, the relatively quick refilling of the system will allow such operation with a reasonable duty cycle being used. This is not to say however, that the complete exhausting of the water from a nozzle 22 and the associated sounds caused thereby could not be used for its sound effect value, though the same would somewhat limit how quickly thereafter additional spurts of water could be produced by the corresponding nozzle or nozzles.

The pressure of the air used, the size of the nozzles, etc., is of course variable depending upon the nature of the display desired. In that regard however, it should be noted that because of the simplicity of the system and the high pressure capabilities of typical components thereof, substantial pressures can be used to result in a display of substantial size and water height capability. On the other hand, lower pressures, smaller, submerged and/or aeriated nozzles and associated components, etc., may also be used to provide attention getting water displays of a much more limited size, such as might be used in atrium pools, etc. As a further alternative, one could vary the air pressure being supplied to the system under computer control also, alone or in coordination with music, etc., to provide a still further dimension to the display. Thus, while certain preferred and alternate embodiments have been disclosed and described herein, it will be understood by those skilled in the art that various changes in form and detail may be made in the invention without departing from the spirit and scope thereof.

We claim:

1. An air powered water display comprising:

at least one nozzle disposed to direct water therefrom;

water reservoir means disposed below the surface of a pool of water and coupled to said at least one nozzle for supplying water thereto;

means for controllably supplying air under pressure to said water reservoir means to force water therefrom and out said at least one nozzle, and for controllably removing air pressure from said water reservoir when water is being forced out of said reservoir to stop the same; and, refilling means coupled to said water reservoir means for allowing water to flow into said water reservoir means from a pool of water below the surface of which said water reservoir means is disposed when the pressure of the water in the pool of water adjacent said refilling means is higher than the pressure of the water in the water reservoir means adjacent said refilling means.

2. The air powered water display of claim 1 wherein said refilling means is a check valve means.

3. The air powered water display of claim 1 wherein said means for controllably supplying air under pressure to said water reservoir means and for removing air pressure therefrom comprises:

a source of air under pressure; and, control means having first and second states, said first state coupling said source of air under pressure to said water reservoir means and said second state venting said water reservoir means to ambient pressure.

4. The air powered water display of claim 3 wherein said control means is a three port solenoid valve operative to controllably couple the first port thereof to the second port thereof when in said first state and to controllably couple the second port thereof to the third port thereof when in said second state, said first port being coupled to said source of air under pressure, said second port being coupled to said water reservoir means and said third port being vented to ambient pressure.

5. The air powered water display of claim 3 further comprised of computer means coupled to said control means for controlling the same by program control.

6. The air powered water display of claim 1 further comprised of air speed sensing means coupled to said means for controllably supplying air under pressure to said water reservoir means for varying the pressure of the air supplied by said means for controllably supplying air under pressure to said water reservoir means responsive to the speed of air around the water display.

7. The air powered water display of claim 1 wherein the at least one nozzle is disposed with the outlet thereof slightly above the surface of the pool of water.

8. The air powered water display of claim 1 wherein the at least one nozzle is disposed with the outlet thereof slightly below the surface of the pool of water.

9. The air powered water display of claim 1 wherein said water reservoir means is coupled to said at least one nozzle adjacent the bottom of said reservoir means and said means for controllably supplying air under pressure to said water reservoir means is coupled to said water reservoir means adjacent the top thereof.

10. An air powered water display comprising:

at least one nozzle disposed to direct water therefrom;

water reservoir means disposed under a pool of water and coupled adjacent the bottom of said reservoir to said at least one nozzle for supplying water thereto;

means for controllably supplying air under pressure to said water reservoir means adjacent the top thereof and for removing air pressure therefrom; and, check valve means coupled to said water reservoir means for allowing water to flow into said water reservoir means from a pool of water in which said water reservoir means is disposed when the pressure of the water in the pool of water adjacent said check valve means is higher than the pressure of the water in said water reservoir means adjacent said check valve means.

11. The air powered water display of claim 10 wherein said means for controllably supplying air under pressure to said water reservoir means and for removing air pressure therefrom comprises:

a source of air under pressure; and, control means having first and second states, said first state coupling said source of air under pressure to said water reservoir means and said second state venting said water reservoir means to ambient pressure.

12. The air powered water display of claim 11 wherein said control means is a three port solenoid valve operative to controllably couple the first port thereof to the second port thereof when in said first state and to controllably couple the second port thereof to the third port thereof when in said second state, said first port being coupled to said source of air under pressure, said second port being coupled to said water reservoir means and said third port being vented to ambient pressure.

13. The air powered water display of claim 11 further comprised of computer means coupled to said control means for controlling the same by program control.

14. The air powered water display of claim 10 further comprised of air speed sensing means coupled to said means for controllably supplying air under pressure to said water reservoir means for varying the pressure of the air supplied by said means for controllably supplying air under pressure to said water reservoir means responsive to the speed of air around the water display.

15. The air powered water display of claim 10 wherein the at least one nozzle is disposed with the outlet thereof slightly above the surface of the pool of water.

16. The air powered water display of claim 10 wherein the at least one nozzle is disposed with the outlet thereof slightly below the surface of the pool of water.

17. An air powered water display comprising:

a plurality of nozzles disposed to direct water therefrom;

a plurality of water reservoir means disposed below the surface of a pool of water, each coupled to one of said nozzles for supplying water thereto;

means for controllably and independently supplying air under pressure to each of said water reservoir means to force water therefrom and out the respective nozzle, and for controllably removing air pressure from the respective said water reservoir when water is being forced out of said reservoir to stop the same; and, refilling means coupled to each said water reservoir means for allowing water to flow into the respective said water reservoir means from a pool of water below the surface of which said water reservoir means is disposed when the pressure of the water in the pool of water adjacent said refilling means is higher than the pressure of the water in the respective water reservoir means adjacent said refilling means.

18. The air powered water display of claim 17 wherein each said refilling means is a check valve means.

19. The air powered water display of claim 17 wherein said means for controllably and independently supplying air under pressure to each said water reservoir means and for removing air pressure therefrom comprises:

a source of air under pressure; and, control means coupled between said source of air under pressure and each of said water reservoir means, said control means having first and second states for each of said water reservoir means, said first state coupling said source of air under pressure to the respective said water reservoir means and said second state venting the respective said water reservoir means to ambient pressure.

20. The air powered water display of claim 19 wherein said control means for each said reservoir is a three port solenoid valve operative to controllably couple the first port thereof to the second port thereof when in said first state and to controllably couple the second port thereof to the third port thereof when in said second state, said first port being coupled to said source of air under pressure, said second port being coupled to the respective said water reservoir means and said third port being vented to ambient pressure.

21. The air powered water display of claim 19 further comprised of computer means coupled to said control means for controlling the same by program control.

22. The air powered water display of claim 21 wherein said computer means is a means for independently controlling the air pressure in each said water reservoir means.

23. The air powered water display of claim 17 further comprised of air speed sensing means coupled to said means for controllably supplying air under pressure to said water reservoir means for varying the pressure of the air supplied by said means for controllably supplying air under pressure to said water reservoir means responsive to the speed of air around the water display.

24. The air powered water display of claim 17 wherein at least some of said nozzles are disposed with the outlet thereof slightly above the surface of the pool of water.

25. The air powered water display of claim 17 wherein at least some of said nozzles are disposed with the outlet thereof slightly below the surface of the pool of water.

26. The air powered water display of claim 17 wherein each said water reservoir means is coupled to the respective said nozzle adjacent the bottom of said reservoir means and said means for controllably supplying air under pressure to said water reservoir means is coupled to each said water reservoir means adjacent the top thereof.

27. An air powered water display comprising:

a plurality of nozzles disposed to direct water therefrom;

a plurality of water reservoir means disposed under a pool of water, each coupled adjacent the bottom thereof to one of said nozzles for supplying water thereto;

means for controllably and independently supplying air under pressure to each of said water reservoir means adjacent the top thereof to force water therefrom and out the respective nozzle, and for removing air pressure therefrom; and, check valve means coupled to each said water reservoir means for allowing water to flow into the respective said water reservoir means from a pool of water in which said water reservoir means is disposed when the pressure of the water in the pool of water adjacent said check valve means is higher than the pressure of the water in the respective water reservoir means adjacent said check valve means.

28. The air powered water display of claim 27 wherein said means for controllably and independently supplying air under pressure to each said water reservoir means and for removing air pressure therefrom comprises:

a source of air under pressure; and, control means coupled between said source of air under pressure and each of said water reservoir means, said control means having first and second states for each of said water reservoir means, said first state coupling said source of air under pressure to the respective said water reservoir means and said second state venting the respective said water reservoir means to ambient pressure.

29. The air powered water display of claim 28 wherein said control means for each said reservoir is a three port solenoid valve operative to controllably couple the first port thereof to the second port thereof when in said first state and to controllably couple the second port thereof to the third port thereof when in said second state, said first port being coupled to said source of air under pressure, said second port being coupled to the respective said water reservoir means and said third port being vented to ambient pressure.

30. The air powered water display of claim 28 further comprised of computer means coupled to said control means for controlling the same by program control.

31. The air powered water display of claim 30 wherein said computer means is a means for independently controlling the air pressure in each said water reservoir means.

32. The air powered water display of claim 27 further comprised of air speed sensing means coupled to said means for controllably supplying air under pressure to said water reservoir means for varying the pressure of the air supplied by said means for controllably supplying air under pressure to said water reservoir means responsive to the speed of air around the water display.

33. The air powered water display of claim 27 wherein at least some of said nozzles are disposed with the outlet thereof slightly above the surface of the pool of water.

34. The air powered water display of claim 27 wherein at least some of said nozzles are disposed with the outlet thereof slightly below the surface of the pool of water.

35. A method of generating a water display comprising the steps of:

(a) providing;

(i) at least one nozzle disposed to direct water therefrom;

(ii) water reservoir means disposed under a pool of water and coupled adjacent the bottom of said reservoir to said at least one nozzle for supplying water thereto;

(iii) means for controllably supplying air under pressure to said water reservoir means adjacent the top thereof and for removing air pressure therefrom, said last named means including a source of air under pressure and a controllable valve means; and, (iv) check valve means coupled to said water reservoir means for allowing water to flow into said water reservoir means from a pool of water in which said water reservoir means is disposed when the pressure of the water in the pool of water adjacent said check valve means is higher than the pressure of the water in said water reservoir means adjacent said check valve means;

(b) controlling said valve means in time and duration to provide bursts of water from said at least one nozzle correspondingly controlled in time and duration to provide a form of dynamic water display using a duty cycle which keeps sufficient water in said water reservoir means to prevent air from the supply of air under pressure from being expelled from said at least one nozzle during a burst of water from said at least one nozzle.

36. The method of claim 35 wherein said controllable valve means is an electrically controllable valve means and step (b) is carried out by a computer under program control.

37. A method of generating a water display comprising the steps of:

(a) providing;

(i) a plurality of nozzles disposed to direct water therefrom;

(ii) a plurality of water reservoir means disposed under a pool of water, each coupled adjacent the bottom thereof to one of said nozzles for supplying water thereto;

(iii) a plurality of controllable valve means, each for controllably and independently supplying air under pressure to each of said water reservoir means adjacent the top thereof to force water therefrom and out the respective nozzle, and for removing air pressure therefrom; and, (iv) check valve means coupled to each said water reservoir means for allowing water to flow into the respective said water reservoir means from a pool of water in which said water reservoir means is disposed when the pressure of the water in the pool of water adjacent said check valve means is higher than the pressure of the water in the respective water reservoir means adjacent said check valve means;

(b) controlling each said valve means in time and duration to provide bursts of water from said plurality of nozzles correspondingly controlled in time and duration to provide a form of dynamic water display using a duty cycles for each said valve means which keeps sufficient water in the respective said water reservoir means to prevent air from the supply of air under pressure from being expelled from the respective said nozzle during a burst of water from said last named nozzle.

38. The method of claim 37 wherein said plurality of controllable valve means are electrically controllable valve means and step (b) is carried out by a computer under program control.

39. A method of generating a water display comprising the steps of:

(a) providing;

(i) at least one nozzle disposed to direct water therefrom;

(ii) water reservoir means coupled adjacent the bottom of said reservoir to said at least one nozzle for supplying water thereto;

(iii) means for controllably supplying air under pressure to said water reservoir means adjacent the top thereof and for venting air pressure therefrom, said last named means including a source of air under pressure and a controllable valve means; and, (iv) means coupled to said water reservoir means for providing water to said water reservoir means when the air pressure is vented from said water reservoir means;

(b) controlling said valve means in time and duration to provide bursts of water from said at least one nozzle correspondingly controlled in time and duration to provide a form of dynamic water display using a duty cycle which keeps sufficient water in said water reservoir means to prevent air from the supply of air under pressure from being expelled from said at least one nozzle during a burst of water from said at least one nozzle.

40. The method of claim 39 wherein said controllable valve means is an electrically controllable valve means and step (b) is carried out by a computer under program control.

41. A method of generating a water display comprising the steps of:

(a) providing;

(i) a plurality of nozzles disposed to direct water therefrom;

(ii) a plurality of water reservoir means, each coupled adjacent the bottom thereof to one of said nozzles for supplying water thereto;

(iii) a plurality of controllable valve means, each for controllably and independently supplying air under pressure to each of said water reservoir means adjacent the top thereof to force water therefrom and out the respective nozzle, and for venting air pressure therefrom; and, (iv) check valve means coupled to each said water reservoir means for allowing water to flow into the respective said water reservoir means from a pool of water in which said water reservoir means is disposed when the pressure of the water in the pool of water adjacent said check valve means is higher than the pressure of the water in the respective water reservoir means adjacent said check valve means;

(v) means coupled to each said water reservoir means for providing water to the respective said water reservoir means when air pressure is vented from the respective said water reservoir means;

(b) controlling each said valve means in time and duration to provide bursts of water from said plurality of nozzles correspondingly controlled in time and duration to provide a form of dynamic water display using a duty cycles for each said valve means which keeps sufficient water in the respective said water reservoir means to prevent air from the supply of air under pressure from being expelled from the respective said nozzle during a burst of water from said last named nozzle.

42. The method of claim 41 wherein said plurality of controllable valve means are electrically controllable valve means and step (b) is carried out by a computer under program control.

* * * * *